United States Patent [19]

Buschkens et al.

[11] Patent Number: 4,586,343

[45] Date of Patent: May 6, 1986

[54] PROCESS AND DEVICE FOR METERING SMALL AMOUNTS OF A LOW BOILING LIQUIFIED GAS

[75] Inventors: Guido Buschkens, Krefeld-Traar; Peter Nobis, Neuss, both of Fed. Rep. of Germany

[73] Assignee: Messer Griesheim GmbH, Frankfurt, Fed. Rep. of Germany

[21] Appl. No.: 689,790

[22] Filed: Jan. 8, 1985

[30] Foreign Application Priority Data

Jan. 24, 1984 [DE] Fed. Rep. of Germany ..... 3402292

[51] Int. Cl.[4] ..... F17C 7/02

[52] U.S. Cl. ..... 62/55; 62/514 R; 137/13; 137/803

[58] Field of Search ..... 62/49, 55, 514 R, 514 JT; 137/13, 803

[56] References Cited

U.S. PATENT DOCUMENTS

| | | | |
|---|---|---|---|
| 2,436,411 | 2/1948 | Weaver | 62/49 |
| 2,834,366 | 5/1958 | Bond, Jr. | 137/251 |
| 3,270,756 | 9/1966 | Dryden | 137/13 |
| 3,481,205 | 12/1969 | Schmidlin | 137/251 |
| 3,605,424 | 9/1971 | Paine | 62/55 |
| 3,631,870 | 1/1972 | Livingston | 137/13 |
| 3,933,003 | 1/1976 | Markum | 62/514 JT |
| 4,080,802 | 3/1978 | Annable | 62/514 JT |

*Primary Examiner*—Ronald C. Capossela

*Attorney, Agent, or Firm*—Connolly and Hutz

[57] ABSTRACT

The invention concerns a process and device for metering small amounts of a low boiling liquified gas which flows from an orifice of a cold-insulated vessel. In this process and device the orifice of the vessel is sealed off by a gas bubble.

18 Claims, 5 Drawing Figures

PROCESS AND DEVICE FOR METERING SMALL AMOUNTS OF A LOW BOILING LIQUIFIED GAS

BACKGROUND OF THE INVENTION

When metering small amounts of low boiling liquified gas, especially with a liquid nitrogen metering device, an even throughput of the liquified gas which can be shut off at any time and which can, on demand, be turned on and off in a cyclic manner must be attainable.

DE-OS No. 27 32 318 discloses an apparatus for metering liquid nitrogen whereby a disk which rotates about a vertical axis is moved along under the orifice for liquid nitrogen. Depending upon the shape of the disk, the orifice is closed to a greater or lesser degree. Only a cyclic metering of the liquid nitrogen is possible with such a mechanical apparatus.

It is furthermore known from DE-OS No. 31 41 465 that one can regulate the metering of the low boiling liquified gas through a needle valve which forms the orifice. The valve stem of the needle valve is hereby pulled upward so that liquid nitrogen can exit from the body of the vessel of the metering device.

It is, however, necessary after prolonged idle periods with emptying vessel and subsequent refilling, to make operational the valve opening which is either frozen shut or which can no longer close tightly by means of a heating arrangement. Also, ice crystals which occur during operation due to moisture in the air lead to an uneven flow of the liquified gas.

SUMMARY OF THE INVENTION

The object of the invention is to make possible a trouble-free metering of small amounts of low boiling liquified gas in the simplest manner.

The advantages attained with the invention consist especially therein that a trouble-free turning "on" and "off" of a stream of low boiling liquified gas can be assured in the simplest possible manner. Thus, before filling the system with the liquid, the orifice and the chamber in particular and possibly even the entire system can be flushed with dry gas.

THE DRAWINGS

FIG. 1 is a longitudinal section of a device for executing the process according to the invention;

FIGS. 2*a* and 2*b* show two developments of the shut-off device according to the invention; and FIGS. 3*a* and 3*b* show two developments of the shut-off device with a tubular vessel.

DETAILED DESCRIPTION

Figure 1:
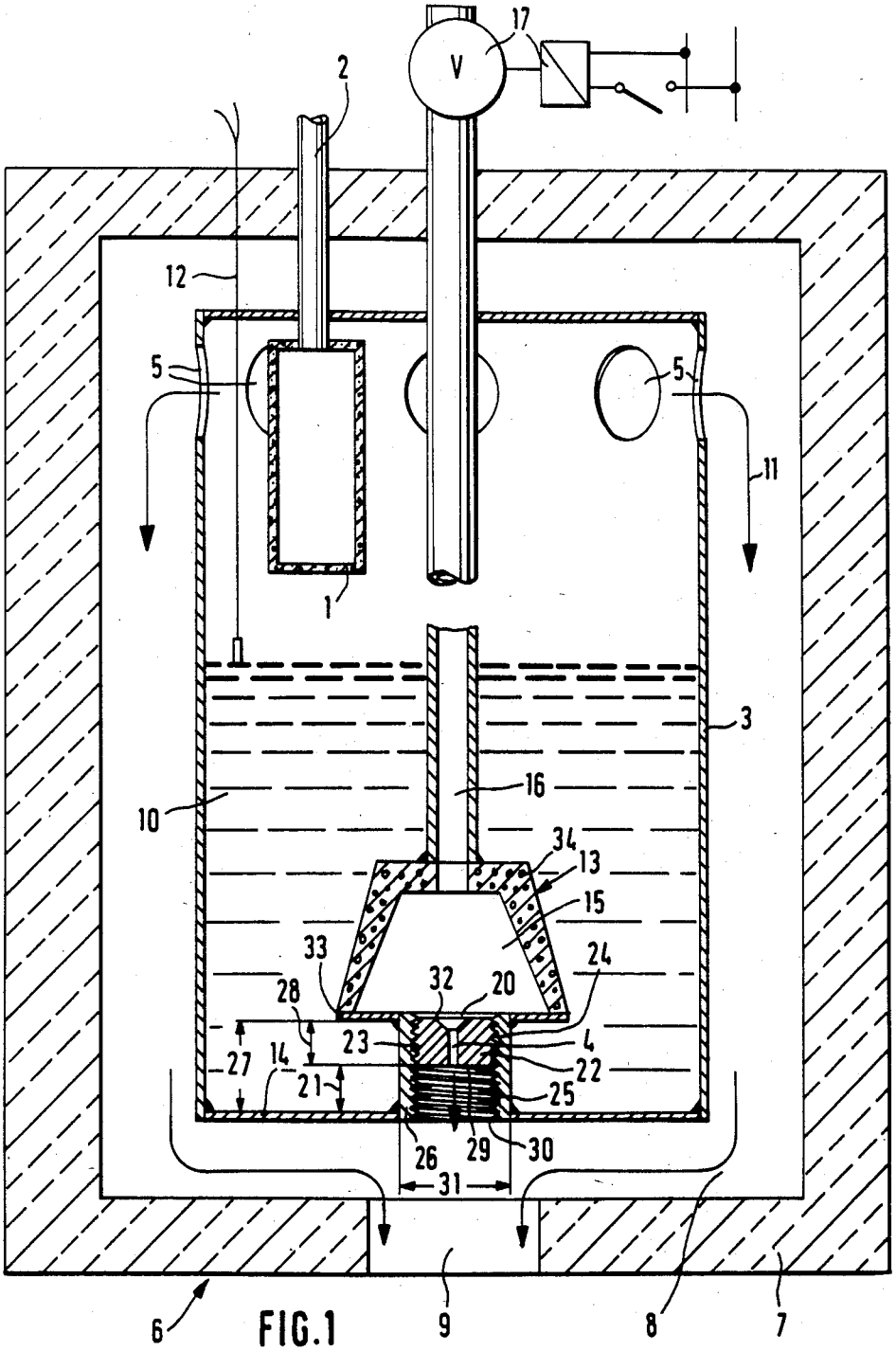

The device illustrated in FIG. 1 consists of a sintered metal body 1 which is located at the end of the pipe 2 which serves to feed the liquified gas. The sintered metal body 1 is installed in a vessel 3 which has an orifice 4 for liquified gas that is mounted in one of the vessel's walls 14 at a distance 21 inside the vessel 3 and which exhibits several outlet ports 5 for vaporized gas located in its upper region.

The orifice 4 is installed in a preferably cylindrical body 22 which has at its circumference 23 a thread 24. The body 22 is, by means of its male thread 24, screwed into a tubular support 26 equipped with a female thread 25, the length 27 of the tubular support which projects inward being greater than the width 28 of the body 22.

The tubular support 26 is mounted, with the face 30, which is next to the outlet side 29 of the orifice 4, in an opening in the vessel wall 14 corresponding to its diameter 31 and is welded to the vessel wall 14.

Before the inlet 32 of the orifice 4, there is a pot shaped, porous sintered metal body 13 which is built onto a disk 33 which is firmly attached to a tubular support 26, with said body 13 forming a chamber 15 with the disk 33 serving as its floor. A pipe 16, which can be shut off with a valve 17, is connected to the chamber 15. The vessel 3 is, in turn, surrounded by a second vessel 6 which is equipped with insulation. A space 8 is formed between the vessels 3 and 6. The vessel 6 and the insulation 7 have a gas outlet opening 9 which is located beneath the orifice 4 for liquified gas in the vessel 3.

The operation of the device according to the invention is as follows: the liquified gas, e.g., nitrogen, arrives via the pipe 2 in the sintered metal body 1, the cross-section of which is greater than that of the supply line. The sintered metal body 1 is permeable to gaseous and liquified gas. The expanded boiling liquid nitrogen 10, now at atmospheric pressure and at −196° Celsius collects at the bottom of the vessel 3. The cold gaseous nitrogen, likewise at −196° Celsius, passes through the outlet ports 5 into the space 8 between the vessels 3 and 6. The flow of the gas is indicated by the arrow 11. The cold gas now flows slowly toward the large gas outlet opening 9 and cools the entire device so much that a minimal amount of heat from the outside is transferred to the liquid nitrogen located in the vessel 3. Because of the low velocity of the gaseous nitrogen 11, the stream of liquid nitrogen is not disturbed by the gas stream. Since the orifice 4 consists of an exchangeable body 22, the strength of the exiting stream of liquid can be varied according to the demand per unit time. Aside from the cross-section of the orifice 4, the height of the surface of the liquid nitrogen 10 also determines the amount of the continually exiting liquid nitrogen per unit time. Because of this, the height of the surface is held constant by means of a vertically adjustable measuring probe 12 which, according to the demand, opens or closes a magnetic valve (not detailed) installed in the pipe 2. The metered liquid stream which continually exits from the orifice 4 is securely shut off by the continuous supply of a sealing gas into the chamber 15. As a result of the installation of the body 22 which contains the orifice 4 at a distance 21 inside the vessel 3, the orifice 4 is surrounded over its entire width 28 with liquid nitrogen 10 so that the orifice 4 is cooled during the entire time that the liquid stream is shut off. Additionally as a result of the rising of the sealing gas bubbling through the liquid nitrogen, a cooling of the device is achieved in the space 8 during the shut down of the liquid stream. With a sealing pressure of 0.1 to 0.4 bar, in particular, above the pressure of the liquid nitrogen along with a very low usage, an adequate sealing pressure is achieved which frees the chamber 15 from liquid and keeps the orifice 4 dry without it yielding a mixture of the dry sealing gas with the liquid. The low sealing pressure is thereby attained as a result of mounting of body 13 before the orifice 4 whereby, on the one hand, the hydrostatic pressure of the liquid nitrogen 10 on the chamber 15 is reduced and, on the other hand, extraneous foreign particles such as metal filings are kept away from the orifice 4. The sealing gas which is fed, at this pressure, into the chamber 15, preferably having a chamber volume of ca. 10 $cm^3$, escapes, on the one hand, through the orifice 4 which has, along with this low chamber volume a diameter of ca. 2 mm and, on the other hand, through the irregularly shaped openings 34 in the sintered metal body 13. When the supply of gas through the magnetic valve 17 installed in the pipe 16 is interrupted, liquid nitrogen immediately exits again from the orifice 4 without there being any measurable time difference between the interruption of the gas supply and the emergence of the liquid stream. Naturally, there are other cold resistant filters, as for example, sieves, which may be used. The combined openings 34 of the sintered metal body 13 must thereby be greater than the orifice 4 in order to avoid delays in the throughput through the orifice 4.

It has been shown to be particularly advantageous to use the device's own very cold boiling gases as sealing or drying gases. Of course, it is also possible to use other dry sealing gases whose boiling temperature is lower than that of the liquid gases as, for example, helium gas liquid $N_2$ or else $N_2$ gas for liquid argon.

Figure 2:
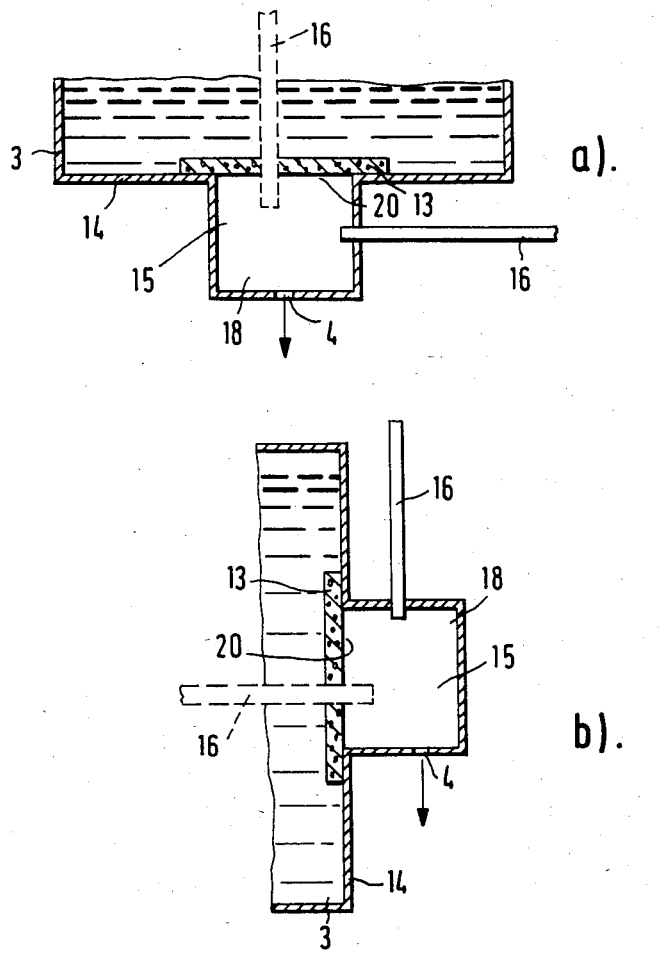

FIG. 2 shows a further development of the shut-off device according to the invention whereby a vertical arrangement of the chamber 15 is schematically illustrated in FIG. 2*a* and a horizontal arrangement in FIG. 2*b*. The chamber 15 is hereby formed by an ante-chamber 18 built on before the vessel wall 14 of the vessel 3, whose opening passage 20 for the liquid nitrogen is sealing with a plate-like sintered metal body 13. The orifice 4 which can be made simply and inexpensively according to the process of the invention is located in the ante-chamber 18. The pipe 16 for the sealing gas which can be connected to the chamber 15 horizontally or vertically (illustrated with dotted lines) discharges into the chamber 15.

Figure 3:
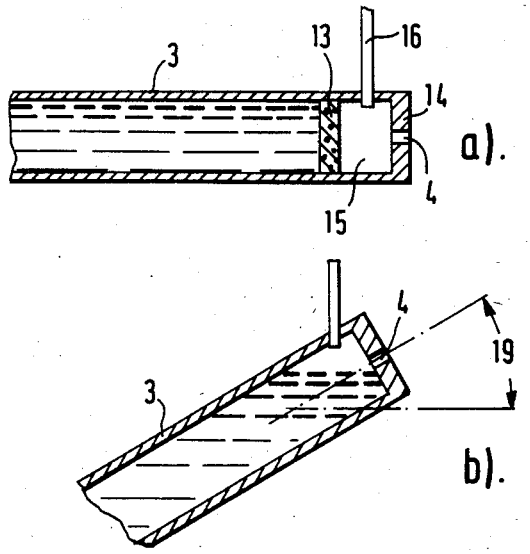

FIG. 3 schematically illustrates a horizontally arranged tubular vessel 3, in the front wall 14 of which the orifice 4 is located. The chamber 15 of the tubular vessel 3 is produced by the incorporation of a plate shaped sintered metal body 13. The pipe 16 for the supply of sealing gas is connected to the chamber 15.

If the tubular vessel 3 leading to the orifice 4 is at an angle of elevation 19 from the horizontal, of preferably greater than 15 degrees, or if the vessel 3 which is not further detailed, exhibits an inverted L-shaped external contour whereby the orifice 4 is located in its upper, angled part, then the shut-off device operates without a sintered metal body 13. The chamber 15 is hereby formed by the gas bubbles contained within the tubular vessel.

What is claimed is:

1. In a process for metering small amounts of a low boiling liquified gas which flows from an orifice of a cold insulated vessel wherein the process includes feeding the liquified gas into the vessel, collecting the liquified gas in liquid form at the bottom of the vessel, and flowing some of the liquified gas in liquid form through the orifice, the improvement being feeding a sealing gas to the orifice, and selectively closing the orifice by means of a gas bubble from the sealing gas to prevent flow of the liquid form liquified gas from the orifice.

2. Process according to claim 1, including forming the gas bubble when the sealing gas is at a pressure of 0.1 to 5 bar above the pressure of the liquified gas.

3. Process according to claim 1, including forming the gas bubble when the sealing gas is at a pressure of 0.1 to 0.4 bar above the pressure of the liquified gas.

4. Process according to claim 1, including disposing the vessel leading to the orifice to an orientation at an angle of elevation from the horizontal to create an upper corner, and feeding the sealing gas to the upper corner.

5. Process according to claim 4, including disposing the vessel leading the orifice to an orientation at an angle of elevation from the horizontal greater than 15 degrees.

6. Process according to claim 1, including feeding the sealing gas to a chamber which communicates in the direction of the liquified gas with the orifice, locating the orifice as a passageway through a body disposed within the vessel and thereby surrounding the orifice with the liquid form liquified gas, disposing the vessel within and spaced from the inner wall of an insulated outer vessel, conveying the gaseous form of the liquified gas through outlet ports in the vessel and into the space between the vessel and the inner wall of the outer vessel, conveying the gaseous form through the space and along the lower portion and bottom of the vessel, and exiting the gaseous form through an opening in the bottom of the outer vessel which is located beneath the orifice for the liquid form of liquified gas.

7. Process according to claim 1, including feeding the sealing gas to a chamber located below and in communication with the vessel with the orifice being a passageway through a wall of the chamber.

8. Process according to claim 1, including feeding the sealing gas to a chamber located at the side of and in communication with the vessel.

9. A device for metering small amounts of a liquified gas comprising an insulated vessel, feed means for feeding liquified gas into said vessel at a location spaced from the bottom of said vessel, an orifice at said bottom of said vessel located below the level of the liquid form of liquified gas in said vessel for discharging said liquid form of liquified gas from said vessel, shut-off means at said orifice for selectively closing said orifice to prevent the flow of said liquid form of liquified gas therefrom, said shut-off means including a chamber communicating with said orifice and having openings therethrough, a pipe communicating with said chamber, and means for supplying a sealing gas through said pipe and into said chamber for selectively creating a gas bubble at said orifice to seal off the flow of said liquid form of liquified gas through said orifice.

10. Device according to claim 9, characterized in that said orifice is a passageway through a body, and said chamber and said body being arranged at a distance inside said vessel and surrounded by said liquid form of liquified gas.

11. Device according to claim 9, characterized therein that at least one opening of said chamber is designed as a porous body.

12. Device according to claim 11, characterized therein that the sum of the openings of said porous body is greater than the open area of said orifice.

13. Device according to claim 12, characterized therein that said porous body is a pot shaped sintered body.

14. Device according to claim 9, characterized therein that said feed means comprises a feed pipe extending into said vessel and terminating in a hollow sintered body, said vessel being mounted in an insulated outer vessel peripherally spaced from the inner wall of said outer vessel to create a space around the sides and bottom of said vessel, an outlet opening in said outer vessel beneath and in communication with said orifice, and outlet ports in said vessel whereby the gaseous form of said liquified gas may flow through said outlet ports and into said space and then exit through said outlet opening.

15. Device according to claim 14, characterized therein that said orifice is a passageway extending through a body located in said vessel spaced above said bottom of said vessel, said chamber being formed by an inverted pot shaped porous body mounted on a disk having an aperture communicating with said orifice, and said body being mounted in a support secured to said bottom.

16. Device according to claim 14, characterized in that said chamber is an ante-chamber secured to and mounted below said bottom, and said orifice being an aperture extending through the wall of said ante-chamber.

17. Device according to claim 9, characterized in that said chamber is formed at the side of said vessel separated from said vessel by a plate shaped sintered wall.

18. Device according to claim 9, characterized therein that said vessel is disposed at an angle greater than 15 degrees to the horizontal to form an upper corner, said orifice being an aperture extending through the wall of said vessel at said upper corner, and said upper corner comprising said chamber.

* * * * *